US011705033B2

(12) United States Patent
Wang et al.

(10) Patent No.: US 11,705,033 B2
(45) Date of Patent: Jul. 18, 2023

(54) SCANNING DRIVING METHOD, SCANNING DRIVING DEVICE, ELECTRONIC EQUIPMENT, AND STORAGE MEDIUM

(71) Applicant: TCL CHINA STAR OPTOELECTRONICS TECHNOLOGY CO., LTD., Guangdong (CN)

(72) Inventors: Yue Wang, Shenzhen (CN); Yuntao Li, Shenzhen (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 538 days.

(21) Appl. No.: 16/963,704

(22) PCT Filed: Jul. 10, 2020

(86) PCT No.: PCT/CN2020/101280
§ 371 (c)(1),
(2) Date: Jul. 21, 2020

(87) PCT Pub. No.: WO2021/243806
PCT Pub. Date: Dec. 9, 2021

(65) Prior Publication Data

US 2023/0124837 A1 Apr. 20, 2023

(30) Foreign Application Priority Data

Jun. 2, 2020 (CN) ..... 202010487571.8

(51) Int. Cl.
*G09G 3/20* (2006.01)

(52) U.S. Cl.
CPC ..... *G09G 3/20* (2013.01); *G09G 2310/0213* (2013.01); *G09G 2310/0251* (2013.01); *G09G 2310/0267* (2013.01)

(58) Field of Classification Search
CPC ..... G09G 3/20; G09G 2310/0213; G09G 2310/0251; G09G 2310/0267
See application file for complete search history.

(56) References Cited

U.S. PATENT DOCUMENTS

2003/0132903 A1 7/2003 Ueda
2004/0041802 A1 3/2004 Tsutsui
2018/0301108 A1 10/2018 Wu
(Continued)

FOREIGN PATENT DOCUMENTS

CN 1801306 A 7/2006
CN 1892801 A 1/2007
(Continued)

*Primary Examiner* — Sejoon Ahn
(74) *Attorney, Agent, or Firm* — PV IP PC; Wei Te Chung; Zhigang Ma

(57) ABSTRACT

A method provided by the present application comprises: obtaining a number n of rows of pixel units to be precharged; controlling a scanning driving chip to sequentially output n first scanning enable signals to a scanning driving circuit according to the number n of rows; and outputting a second scanning enable signal to the scanning driving circuit, so that the scanning driving circuit is controlled to output a second scanning signal to the pixel units of the n-th row to charge the pixel units of the n-th row.

16 Claims, 2 Drawing Sheets

(56) References Cited

U.S. PATENT DOCUMENTS

| | | | | |
|---|---|---|---|---|
| 2018/0357972 | A1 | 12/2018 | Wang | |
| 2019/0005914 | A1 | 1/2019 | Chen | |
| 2020/0152150 | A1 | 5/2020 | Huang | |
| 2021/0117029 | A1* | 4/2021 | Kang | G06F 3/04166 |
| 2021/0118354 | A1* | 4/2021 | Ahn | G09G 3/2074 |
| 2021/0118363 | A1* | 4/2021 | Zhang | G09G 3/3233 |

FOREIGN PATENT DOCUMENTS

| | | | |
|---|---|---|---|
| CN | 101520998 | A | 9/2009 |
| CN | 105825814 | A | 8/2016 |
| CN | 106531115 | A | 3/2017 |
| CN | 106558288 | A | 4/2017 |
| CN | 106683630 | A | 5/2017 |
| CN | 106782381 | A | 5/2017 |
| CN | 106847153 | A | 6/2017 |
| CN | 208433206 | U | 1/2019 |
| KR | 20150059005 | A | 5/2015 |

* cited by examiner

SCANNING DRIVING METHOD, SCANNING DRIVING DEVICE, ELECTRONIC EQUIPMENT, AND STORAGE MEDIUM

CROSS-REFERENCE TO RELATED APPLICATIONS

This is the U.S. National Stage of International Patent Application No. PCT/CN2020/101280 filed Jul. 10, 2020, which in turn claims the benefit of Chinese Patent Application No. 202010487571.8 filed Jun. 2, 2020.

BACKGROUND OF INVENTION

Field of Invention

The present application relates to the field of display technology, and particularly, to a scanning driving method, a scanning driving device, an electronic equipment, and a storage medium.

Description of Prior Art

When designing a panel using a gate drive chip, in order to weaken capacitive coupling between a gate electrode and a pixel electrode, an angle-cutting process is usually performed on a gate waveform to weaken feedthrough. When the gate drive chip uses a precharge function, it is inevitable that there will be angle-cutting in each row. When a panel load is heavy, a depth of the angle-cutting will be pulled down and deepened, the gate needs to climb again to open, and a purpose of launching the precharge function in advance will be weakened or even invalidated.

SUMMARY OF INVENTION

The purpose of an embodiment of the present application is to provide a scanning driving method, a scanning driving device, an electronic equipment, and a storage medium, which can improve the charging efficiency.

The embodiment of the present application provides a scanning driving method, configured for use in a scanning driving chip, wherein the method comprises following steps of:

obtaining a number n of rows of pixel units to be precharged;

controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit;

wherein a duration of each of the first scanning enable signals is same as a duration of the angle-cutting on signal, and a value of n is 2.

In the scanning driving method described in the embodiment of the present application, the step of obtaining a number n of rows of pixel units to be precharged comprises:

obtaining a total number of rows of pixel units of a display panel;

obtaining a current target display mode;

calculating the number n of rows of the pixel units to be precharged according to the target display mode and the total number of rows.

In the scanning driving method described in the embodiment of the present application, the step of controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row comprises:

obtaining a precharge voltage amplitude value and a charge voltage amplitude value;

obtaining an angle-cutting amplitude value according to the precharge voltage amplitude value and the charge voltage amplitude value; and controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

In the scanning driving method described in the embodiment of the present application, the step of obtaining an angle-cutting amplitude value according to the precharge voltage amplitude value and the charge voltage amplitude value comprises:

obtaining a pulse width of each of the first scanning enable signals;

obtaining an angle-cutting slope according to the pulse width and the voltage amplitude value; and obtaining the angle-cutting amplitude value according to the precharge voltage amplitude value, the charge voltage amplitude value, and the angle-cutting slope.

The embodiment of the present application also provides a scanning driving method, configured for use in a scanning driving chip, wherein the method comprises following steps of:

obtaining a number n of rows of pixel units to be precharged;

controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit.

In the scanning driving method described in the embodiment of the present application, the step of obtaining the number n of rows of pixel units to be precharged comprises:

obtaining a total number of rows of pixel units of a display panel;

obtaining a current target display mode;

calculating the number n of rows of the pixel units to be precharged according to the target display mode and the total number of rows.

In the scanning driving method described in the embodiment of the present application, the step of controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row comprises:

obtaining a precharge voltage amplitude value and a charge voltage amplitude value;

obtaining an angle-cutting amplitude value according to the precharge voltage amplitude value and the charge voltage amplitude value; and controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

In the scanning driving method described in the embodiment of the present application, the step of obtaining the angle-cutting amplitude value according to the precharge voltage amplitude value and the charge voltage amplitude value comprises:

obtaining a pulse width of each of the first scanning enable signals;

obtaining an angle-cutting slope according to the pulse width and the voltage amplitude value; and obtaining the angle-cutting amplitude value according to the precharge voltage amplitude value, the charge voltage amplitude value, and the angle-cutting slope.

In the scanning driving method described in the embodiment of the present application, a duration of each of the first scanning enable signals is same as a duration of the angle-cutting on signal.

In the scanning driving method described in the embodiment of the present application, a value of n is 2.

The embodiment of the present application also provides a scanning driving device, configured for use in a scanning driving chip, wherein the device comprises:

an obtaining module, which is configured to obtain a number n of rows of pixel units to be precharged;

a precharge module, which is configured to control the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals;

a charge module, which is configured to output a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit.

In the scanning driving device described in the embodiment of the present application, wherein the obtaining module comprises:

a first obtaining unit, which is configured to obtain a total number of rows of pixel units of a display panel;

a second obtaining unit, which is configured to obtain a current target display mode;

a calculating unit, which is configured to calculate the number n of rows of the pixel units to be precharged according to the target display mode and the total number of rows.

In the scanning driving device described in the embodiment of the present application, wherein the precharge module is specifically configured to:

obtain a precharge voltage amplitude value and a charge voltage amplitude value;

obtain an angle-cutting amplitude value according to the precharge voltage amplitude value and the charge voltage amplitude value; and control the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

In the scanning driving device described in the embodiment of the present application, the precharge module is further specifically configured to:

obtain a pulse width of each of the first scanning enable signals;

obtain an angle-cutting slope according to the pulse width and the voltage amplitude value; and obtain the angle-cutting amplitude value according to the precharge voltage amplitude value, the charge voltage amplitude value, and the angle-cutting slope.

In the scanning driving device described in the embodiment of the present application, a duration of each of the first scanning enable signals is same as a duration of the angle-cutting on signal.

In the scanning driving device described in the embodiment of the present application, a value of n is 2.

The embodiment of the present application further provides an electronic equipment, comprising a processor and a memory, the memory stores computer readable instructions, and when the computer readable instructions are executed by the processor, the operation is as described above the method.

The embodiment of the present application achieves the effect of improving the charging efficiency by obtaining a number n of rows of pixel units to be precharged; controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

BRIEF DESCRIPTION OF DRAWINGS

In order to more clearly explain the technical solutions in the embodiments of the present application, the following will briefly introduce the drawings required in the description of the embodiments. Obviously, the drawings in the following description are only some embodiments of the present application. For those skilled in the art, without doing any creative work, other drawings can be obtained based on these drawings.

DETAILED DESCRIPTION OF PREFERRED EMBODIMENTS

Figure 1:
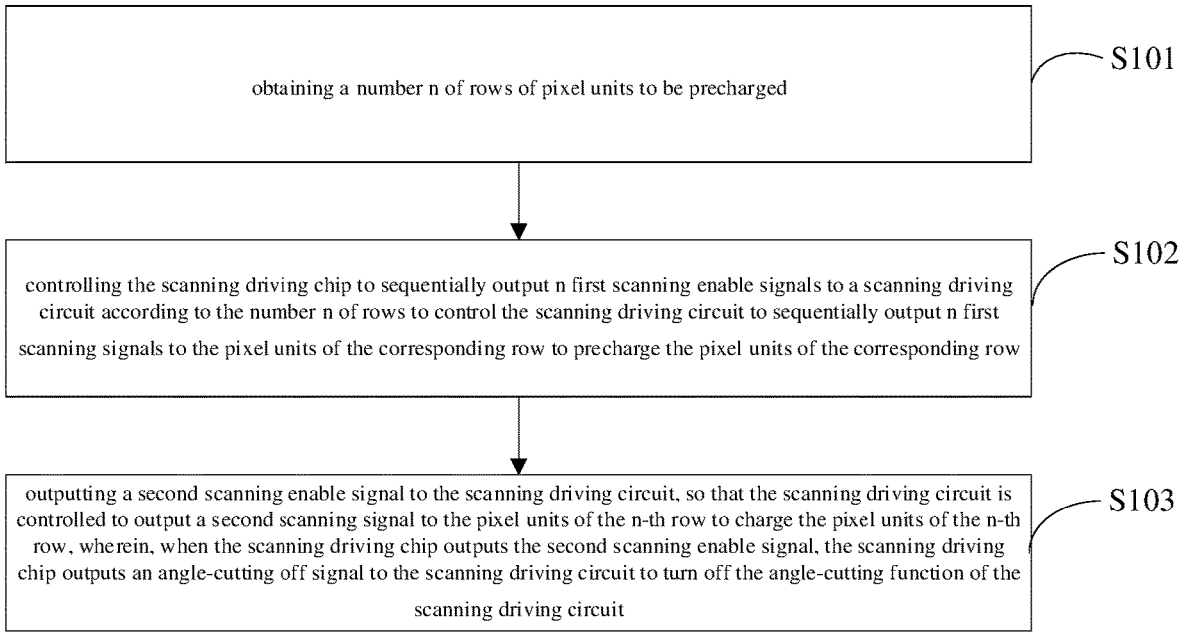
FIG. 1 is a flowchart of a scanning driving method provided by an embodiment of the present application.

The technical solutions in the embodiments of the present application will be described clearly and completely below with reference to the drawings in the embodiments of the present application. Obviously, the described embodiments are only a part of the embodiments of the present application, but not all the embodiments. The components of the embodiments of the present application generally described and illustrated in the drawings herein can be arranged and designed in various configurations. Therefore, the following detailed description of the embodiments of the present application provided in the drawings is not intended to limit the scope of the claimed application, but merely represents selected embodiments of the present application. Based on the embodiments of the present application, all other embodiments obtained by those skilled in the art without making creative work fall within the scope of protection of the present application.

It should be noted that similar reference numerals and letters indicate similar items in the following drawings, therefore, once an item is defined in one drawing, there is no need to further define and explain it in subsequent drawings. Meanwhile, in the description of the present application, the terms "first", "second", etc. are only used to distinguish the description and cannot be understood as indicating or implying relative importance.

Please refer to FIG. 1. FIG. 1 is a flowchart of a scanning driving method in some embodiments of the present application. The method is used in a scanning driving chip. The method comprises following steps of:

S101, obtaining a number n of rows of pixel units to be precharged.

S102, controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals.

S103, outputting a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

The steps of the scanning driving method will be described in detail below with reference to FIG. 2.

In this step of S101, the row number n of the continuously precharged pixel unit can be set according to the current display mode, or can be set according to the specifications of the display panel, that is, the row number and the number of columns of the pixel unit. The default value may also be used, which is a better value tested by the manufacturer during production.

In some embodiments, this step of S101 comprises following sub-steps of: S1011, obtaining a total number of rows of pixel units of a display panel; S1012, obtaining a current target display mode; and S1013, calculating the number n of rows of the pixel units to be precharged according to the target display mode and the total number of rows.

In this step of S1011, the total number of rows of the pixel units of the display panel may be queried in the memory of the display panel, or may be stored in the scan driver chip in advance. In this step of S1012, the display mode may be a default display mode or a display mode manually selected by the user during use. In this step S1013, the number of precharge lines n corresponding to various display modes and corresponding line numbers has been tested in advance before shipment, and the mapping relationship is stored in the storage area of the scan driver chip. Of course, FLASH memory can also be set independently for storage.

Figure 2:
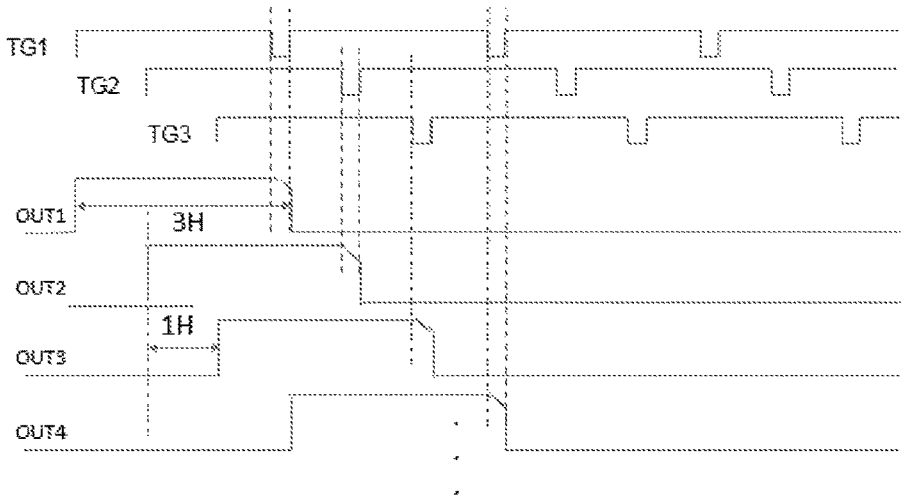
FIG. 2 is a timing diagram of the scanning driving method provided by an embodiment of the present application.

Please refer to FIG. 2 at the same time. In this step of S102, for example, the value of n may be 2. The scan driver chip is provided with N+1 GPIO pins, that is, correspondingly set 3 GPIO pins. In this step, three of the three GPIO pins output the angle-cutting on signals TG1 and TG2, respectively. The three output pins out1, out2, and out3 of the scan driver chip respectively output the first scan enable signal and cooperate with each other, so that the scan driver chip outputs the first scan signal after the angle is cut, so that the pixel units of the corresponding row perform precharging.

Specifically, in some embodiments, this step of S102 comprises following sub-steps of: S1021, obtaining a precharge voltage amplitude value and a charge voltage amplitude value; S1022, obtaining an angle-cutting amplitude value according to the precharge voltage amplitude value and the charge voltage amplitude value; and S1023, controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row; wherein, when the scanning driving chip outputs each of the first scanning enable signals, the scanning driving chip outputs the angle-cutting on signal to the scanning driving circuit to perform the angle-cutting function on each of the first scanning signals, wherein a cut angle of each of the first scanning signals is the angle-cutting amplitude value. Wherein, the duration of the first scanning enable signal is the same as and synchronized with the duration of the angle-cutting on signal. In this step of S1022, it comprises: obtaining a pulse width of each of the first scanning enable signals; obtaining an angle-cutting slope according to the pulse width and the voltage amplitude value; and obtaining the angle-cutting amplitude value according to the precharge voltage amplitude value, the charge voltage amplitude value, and the angle-cutting slope.

In this step of S103, when two lines are precharged, three TG signals are required, so that the TG1, TG2, and TG3 signals control Gate OUT1, Gate OUT2, and Gate OUT3, respectively. When the first two lines are pre-charged, the TG signal is high, Gate OUT1 and Gate OUT2 are turned on. When the third line is actually charged, the TG signal is changed from high to low, and Gate OUT3 starts to cut off and turn off. The signal cycle control is a 3-line period Gate OUT waveform. Then, Gate OUT4 is controlled by TG1, Gate OUTS is controlled by TG2, etc., and all Gate OUT waveforms are controlled cyclically.

It can be seen from the above that the embodiment of the present application achieves the effect of improving the charging efficiency by obtaining a number n of rows of pixel units to be precharged; controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

Figure 3:
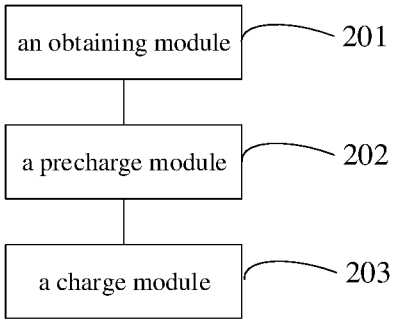
FIG. 3 is a schematic structural diagram of a scanning driving device provided by an embodiment of the present application.

Please refer to FIG. 3. FIG. 3 is a scanning driving device in some embodiments of the present application, which is used in a scanning driving chip. The device comprises: an obtaining module 201, a precharge module 202 and a charge module 203.

The obtaining module 201 is configured to obtain a number n of rows of pixel units to be precharged; the row number n of the continuously precharged pixel unit can be set according to the current display mode, or can be set according to the specifications of the display panel, that is, the row number and the number of columns of the pixel unit . The default value may also be used, which is a better value tested by the manufacturer during production. The obtaining module 201 comprises: a first obtaining unit, which is configured to obtain a total number of rows of pixel units of a display panel; a second obtaining unit, which is configured to obtain a current target display mode; and a calculating unit, which is configured to calculate the number n of rows of the pixel units to be precharged according to the target display mode and the total number of rows. The total number of rows of the pixel units of the display panel may be queried in the memory of the display panel, or may be stored in the scan driver chip in advance. In this step of S1012, the display mode may be a default display mode or a display mode manually selected by the user during use. In this step S1013, the number of precharge lines n corresponding to various display modes and corresponding line numbers has been tested in advance before shipment, and the mapping relationship is stored in the storage area of the scan driver chip. Of course, FLASH memory can also be set independently for storage.

Wherein, the precharge module 202 is configured to control the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals; for example, the value of n may be 2. The scan driver chip is provided with N+1 GPIO pins, that is, correspondingly set 3 GPIO pins. In this step, three of the three GPIO pins output the angle-cutting open signals TG1 and TG2, respectively. The three output pins out1, out2, and out3 of the scan driver chip respectively output the first scan enable signal and cooperate with each other, so that the scan driver chip outputs the first scan signal after the angle is cut, so that the pixel units of the corresponding row perform precharging.

Specifically, in some embodiments, the precharging module 202 is configured to: obtain a precharge voltage amplitude value and a charge voltage amplitude value; obtain an angle-cutting amplitude value according to the precharge voltage amplitude value and the charge voltage amplitude value; and control the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row; wherein, when the scanning driving chip outputs each of the first scanning enable signals, the scanning driving chip outputs the angle-cutting on signal to the scanning driving circuit to perform the angle-cutting function on each of the first scanning signals, wherein a cut angle of each of the first scanning signals is the angle-cutting amplitude value.

Wherein, the duration of the first scanning enable signal is the same as and synchronized with the duration of the angle-cutting on signal. It comprises: obtaining a pulse width of each of the first scanning enable signals; obtaining an angle-cutting slope according to the pulse width and the voltage amplitude value; and obtaining the angle-cutting amplitude value according to the precharge voltage amplitude value, the charge voltage amplitude value, and the angle-cutting slope.

Wherein, the charge module 203 is configured to output a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

It can be seen from the above that the embodiment of the present application achieves the effect of improving the charging efficiency by obtaining a number n of rows of pixel units to be precharged; controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

Figure 4:
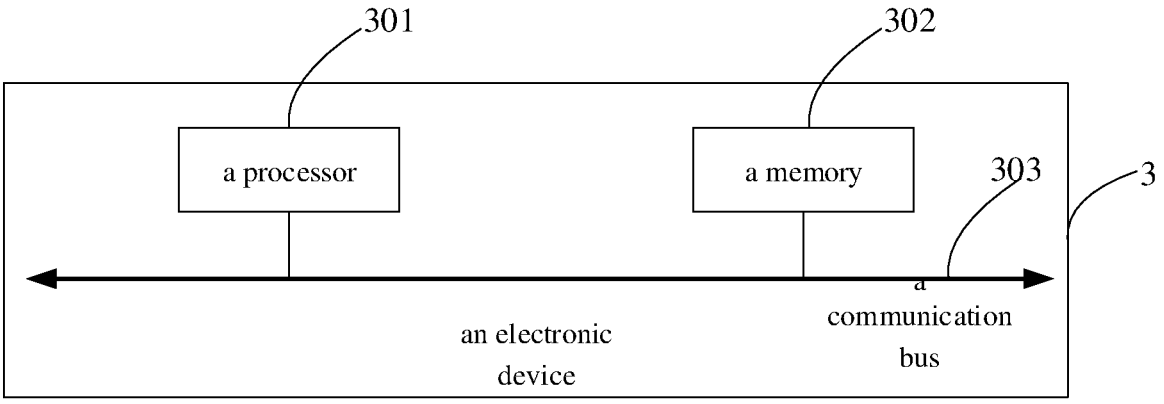
FIG. 4 is a schematic structural diagram of an electronic equipment provided by an embodiment of the present application.

Please refer to FIG. 4. FIG. 4 is a schematic structural diagram of an electronic equipment according to an embodiment of the present application. The present application provides an electronic equipment 3, comprising: a processor 301 and a memory 302, and the processor 301 and the memory 302 via a communication bus 303 and/or other forms of connection mechanisms (not shown) are interconnected and communicate with each other. The memory 302 stores a computer program executable by the processor 301. When the computing device is running, the processor 301 executes the computer program to execute the method in any optional implementation manner of the foregoing embodiments, so as to realize the following functions: obtaining a number n of rows of pixel units to be precharged; controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row; wherein, when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein, when the scanning driving chip outputs the second scanning enable signal, the scanning driving chip outputs an angle-cutting off signal to the scanning driving circuit to turn off the angle-cutting function of the scanning driving circuit.

The embodiment of the present application provides a storage medium. When the computer program is executed by a processor, the method in any optional implementation manner of the foregoing embodiment is executed. Among them, the storage medium can be implemented by any type of volatile or non-volatile storage device or a combination thereof, such as static random access memory (SRAM), electrically erasable programmable read-only memory (EEPROM), erasable programmable read only memory (EPROM), programmable read-only memory (PROM), read-only memory (ROM), magnetic memory, flash memory, magnetic disk, or optical disk.

In this article, relational terms such as first and second are used only to distinguish one entity or operation from another entity or operation, and do not necessarily require or imply the actual relationship or order.

The above are only examples of the present application, and are not used to limit the protection scope of the present application. For those skilled in the art, the present application may have various modifications and changes. Any modification, equivalent replacement, improvement, etc. within the spirit and principle of this application shall be included in the scope of protection of this application.

What is claimed is:

1. A scanning driving method, configured for use in a scanning driving chip, wherein the method comprises following steps of:

obtaining a number n of rows of pixel units to be precharged;

controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit;

wherein a duration of each of the first scanning enable signals is same as a duration of the angle-cutting on signal, and a value of n is 2.

2. The scanning driving method of claim 1, wherein the step of obtaining the number n of rows of pixel units to be precharged comprises:

obtaining a total number of rows of pixel units of a display panel;

obtaining a current target display mode; and calculating the number n of rows of the pixel units to be precharged according to the target display mode and the total number of rows.

3. The scanning driving method of claim 1, wherein the step of controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row comprises:

obtaining a precharge voltage amplitude value and a charge voltage amplitude value;

obtaining an angle-cutting amplitude value according to the precharge voltage amplitude value and the charge voltage amplitude value; and controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

4. The scanning driving method of claim 3, wherein the step of obtaining the angle-cutting amplitude value according to the precharge voltage amplitude value and the charge voltage amplitude value comprises:

obtaining a pulse width of each of the first scanning enable signals;

obtaining an angle-cutting slope according to the pulse width and the voltage amplitude value; and obtaining the angle-cutting amplitude value according to the precharge voltage amplitude value, the charge voltage amplitude value, and the angle-cutting slope.

5. A scanning driving method, configured for use in a scanning driving chip, wherein the method comprises following steps of:

obtaining a number n of rows of pixel units to be precharged;

controlling the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals; and outputting a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit.

6. The scanning driving method of claim 5, wherein the step of obtaining the number n of rows of pixel units to be precharged comprises:

obtaining a total number of rows of pixel units of a display panel;

obtaining a current target display mode;

calculating the number n of rows of the pixel units to be precharged according to the target display mode and the total number of rows.

7. The scanning driving method of claim 5, wherein the step of controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row comprises:

obtaining a precharge voltage amplitude value and a charge voltage amplitude value;

obtaining an angle-cutting amplitude value according to the precharge voltage amplitude value and the charge voltage amplitude value; and controlling the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

8. The scanning driving method of claim 7, wherein the step of obtaining the angle-cutting amplitude value according to the precharge voltage amplitude value and the charge voltage amplitude value comprises:

obtaining a pulse width of each of the first scanning enable signals;

obtaining an angle-cutting slope according to the pulse width and the voltage amplitude value; and obtaining the angle-cutting amplitude value according to the precharge voltage amplitude value, the charge voltage amplitude value, and the angle-cutting slope.

9. The scanning driving method of claim 5, wherein a duration of each of the first scanning enable signals is same as a duration of the angle-cutting on signal.

10. The scanning driving method of claim 5, wherein a value of n is 2.

11. A scanning driving device, configured for use in a scanning driving chip, wherein the device comprises:

an obtaining module, which is configured to obtain a number n of rows of pixel units to be precharged;

a precharge module, which is configured to control the scanning driving chip to sequentially output n first scanning enable signals to a scanning driving circuit according to the number n of rows to control the scanning driving circuit to sequentially output n first scanning signals to the pixel units of the corresponding row to precharge the pixel units of the corresponding row, wherein when the scanning driving chip outputs each of the first scanning enable signals, the scanning driving chip outputs an angle-cutting on signal to the scanning driving circuit to perform an angle-cutting function on each of the first scanning signals;

a charge module, which is configured to output a second scanning enable signal to the scanning driving circuit, so that the scanning driving circuit is controlled to output a second scanning signal to the pixel units of the n-th row to charge the pixel units of the n-th row, wherein when the scanning driving chip outputs the second scanning enable signal, the scanning driving chip outputs an angle-cutting off signal to the scanning driving circuit to turn off the angle-cutting function of the scanning driving circuit.

12. The scanning driving device of claim 11, wherein the obtaining module comprises:

a first obtaining unit, which is configured to obtain a total number of rows of pixel units of a display panel;

a second obtaining unit, which is configured to obtain a current target display mode; and a calculating unit, which is configured to calculate the number n of rows of the pixel units to be precharged according to the target display mode and the total number of rows.

13. The scanning driving device of claim 11, wherein the precharge module is specifically configured to:

obtain a precharge voltage amplitude value and a charge voltage amplitude value;

obtain an angle-cutting amplitude value according to the precharge voltage amplitude value and the charge voltage amplitude value; and control the scanning driving chip to sequentially output the n first scanning enable signals to the scanning driving circuit according to the number n of rows to control the scanning driving circuit to sequentially output the n first scanning signals to the pixel units of the corresponding row to precharge the pixel units of the corresponding row, wherein when the scanning driving chip outputs each of the first scanning enable signals, the scanning driving chip outputs the angle-cutting on signal to the scanning driving circuit to perform the angle-cutting function on each of the first scanning signals, and a cut angle of each of the first scanning signals is the angle-cutting amplitude value.

14. The scanning driving device of claim 11, wherein the precharge module is further specifically configured to:

obtain a pulse width of each of the first scanning enable signals;

obtain an angle-cutting slope according to the pulse width and the voltage amplitude value; and obtain the angle-cutting amplitude value according to the precharge voltage amplitude value, the charge voltage amplitude value, and the angle-cutting slope.

15. The scanning driving device of claim 11, wherein a duration of each of the first scanning enable signals is same as a duration of the angle-cutting on signal.

16. The scanning driving device of claim 11, wherein a value of n is 2.

* * * * *